US005823018A

United States Patent [19]

Lee

[11] Patent Number: 5,823,018

[45] Date of Patent: Oct. 20, 1998

[54] WASHING MACHINE HAVING A SPRAYING NOZZLE ASSEMBLY

[75] Inventor: Jae-Yoll Lee, Kyungki-Do, Rep. of Korea

[73] Assignee: Daewoo Electronics Co., Ltd., Seoul, Rep. of Korea

[21] Appl. No.: 766,210

[22] Filed: Dec. 12, 1996

[30] Foreign Application Priority Data

Dec. 18, 1995 [KR] Rep. of Korea ..... 1995 42260

[51] Int. Cl.[6] ..... D06F 17/00; D06F 39/08

[52] U.S. Cl. ..... 68/23.5; 68/53; 68/207

[58] Field of Search ..... 68/23.5, 53, 184, 68/207

[56] References Cited

U.S. PATENT DOCUMENTS

| | | | |
|---|---|---|---|
| 3,335,584 | 8/1967 | Urban | 68/23.5 X |
| 5,205,141 | 4/1993 | Singh | 68/53 |
| 5,590,552 | 1/1997 | Kim | 68/207 |
| 5,657,650 | 8/1997 | Lee et al. | 68/23.5 |

FOREIGN PATENT DOCUMENTS 2 285 270 7/1995 United Kingdom .

*Primary Examiner*—Philip R. Coe

[57] ABSTRACT

Disclosed is a washing machine having a spraying nozzle assembly which evenly and strongly sprays a circulated washing liquid onto an article to be washed. The washing machine has a housing, an outer tub disposed in the housing so as to receive the washing liquid, a spin tub accommodated in the outer tub, an outer tub cover mounted on the outer tub, and a spraying nozzle assembly for spraying the washing liquid onto the article to be washed which is loaded in the spin tub. The spraying nozzle assembly includes an upper frame mounted on an upper surface of the outer tub cover and a lower frame which is rotatably coupled to a lower portion of the upper frame. The lower frame is formed at a bottom wall thereof with a plurality of spraying nozzles which are regularly arranged in a spiral pattern. The washing machine can evenly and strongly spray the circulated washing liquid onto the articles through the spraying nozzles arranged in the spiral pattern, so the washing effect can be improved without wasting any washing liquid. Since the lower frame rotates while the washing liquid is being sprayed, the washing liquid does not concentrate at one spot of the articles, but sprays widely onto the articles.

14 Claims, 4 Drawing Sheets

WASHING MACHINE HAVING A SPRAYING NOZZLE ASSEMBLY

BACKGROUND OF THE INVENTION

1. Field of the Invention

The present invention relates to a washing machine, and more particularly to a washing machine having a spraying nozzle assembly which can evenly spray a washing liquid which has circulated through a circulation pump onto articles to be washed.

2. Prior Arts

Generally, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the clothing separates from the clothing by means of detergents or friction between the washing liquid and the clothing.

However, in conventional washing machines, detergent particles cannot completely dissolve in the washing liquid while the washing cycle is being executed, so some of the detergent particles remain in a space formed between a spin tub and an outer tub in its solid state. For this reason, the dirt does not easily separate from the clothing and a large quantity of detergents are required for cleaning the clothing.

Further, conventional washing machines repeat the liquid feeding and draining cycles several times in order to carry out the washing and rinsing cycles, so they unnecessarily waste the washing liquid.

In order to overcome the above problems, various types of conventional washing machines which reduce a required amount of the detergent by completely dissolving the detergent in the washing liquid and prevent the washing liquid from wasting by re-using the washing liquid by circulating the washing liquid through a circulation pump, have been proposed.

U.S. Pat. No. 5,285,664 issued to Chang et al. discloses such a conventional washing machine.

FIG. 5 shows Chang's washing machine 500.

As shown in FIG. 5, Chang's washing machine 500 comprises a housing 12 having a control panel 11 at its upper portion, and an outer tub 15 disposed in housing 12 so as to receive the washing liquid. A spin tub 512 is accommodated in outer tub 15 and is formed at its side wall with a plurality of through holes 511. Washing machine 500 also has a motor 17 which generates a driving force for operating washing machine 500, and a power transmission 540 for transmitting the driving force from motor 17 to spin tub 512. A circulation pump 525 is disposed at a bottom of housing 12 in such a manner that it can communicate with outer tub 15. Circulation pump 525 circulates the washing liquid through a circulation tube 521 into an adapter 520, or drains the washing liquid out of washing machine 500 through a drain tube 533.

Power transmission 540 includes a rotating shaft 542 connected to motor 17 through a belt 18 so as to receive the driving force from motor 17, a gear and link assembly 544 for rotating an agitator 548 mounted on a bottom wall of spin tub 512 in the forward and reverse directions in accordance with predetermined cycles, and a connection member 546 for connecting agitator 548 to gear and link assembly 544.

A removable lid 515 having a sprinkling guide surface 516 is mounted on an upper portion of outer tub 15, and is provided at its underside with an annular guide member 514 having a discharge silt 513. In addition, a sprinkling nozzle 518 is formed between annular guide member 514 and removable lid 515 so as to spray the washing liquid into spin tub 512.

On the other hand, circulation pump 525 has a rotating shaft 528 which is integrally formed at its one end with a pulley 529. Pulley 529 of circulation pump 525 is connected to motor 17 by means of a belt 18 in such a manner that circulation pump 525 can receive the rotational force from motor 17.

The conventional washing machine having a construction as described above operates as follows.

Firstly, when a user pushes an operating button installed on control panel 11, the washing liquid is introduced from a liquid source into a space 517 formed between removable lid 515 and guide member 514 by way of a washing liquid feed pipe 519 and adapter 520.

Then, the washing liquid that has been introduced into space 517 is sprinkled into spin tub 512 through discharge silt 513 of guide member 514 and through sprinkle nozzle 518 until a predetermined liquid level in spin tub 512 is achieved.

When the predetermined liquid level is achieved, a liquid feed control valve 530 blocks liquid feed pipe 519 and, at the same time, motor 17 rotates in the forward direction. The rotational force of motor 17 is transmitted to agitator 548 by way of belt 18, by way of rotating shaft 542 of power transmission 540, by way of gear and link assembly 544 and by way of connection member 546, so that agitator 548 rotates in the forward and reverse directions, thereby washing the clothing.

At the same time, the forward directional drive force of drive motor 17 is also transmitted to circulation pump 525 through belt 18, so that circulation pump 525 rotates in the forward direction while the washing cycle is being executed. Therefore, the washing liquid that has been introduced into outer tub 15 is discharged from outer tub 15 into circulation pump 525 through a discharge port 526 formed at the bottom wall of outer tub 15.

Upon receiving the washing liquid, circulation pump 525 compresses the washing liquid and draws the washing liquid up to adapter 520 through circulation tube 521. Then, the compressed washing liquid is introduced into space 517 and sprinkled to the clothing placed in spin tub 512 through discharge slit 513 and sprinkling nozzle 518.

When the washing cycle has finished, the washing liquid in outer tub 15 is drained out of washing machine 500 through draining tube 533. At this time, motor 17 rotates in the reverse direction so as to rotate spin tub 512. As spin tub 512 rotates, the clothing placed in spin tub 512 is subjected to centrifugal force so that the clothing is forced radially outward (i.e., toward the side wall of spin tub 512), and thereby, the washing liquid contained in the clothing is drained out through the plurality of through holes 452 formed in the side wall of spin tub 512.

On the other hand, when motor 17 rotates in the reverse direction, circulation pump 525 connected to motor 17 also rotates in the reverse direction, so the washing liquid discharged from the plurality of through holes 452 is drained out of washing machine 500 through circulation pump 525.

However, the conventional washing machine constructed as described above has the following disadvantages.

Firstly, the washing machine sprays the washing liquid through the sprinkling nozzle which has a relatively small size, so it takes a long time to spray a predetermined amount of the washing liquid into the spin tub.

Further, since the sprinkling nozzle is only formed at one spot of the outer tub, the washing machine does not evenly spray the washing liquid onto the clothing when the clothing is fully loaded in the spin tub.

On the other hand, U.S. Pat. No. 4,791,691 issued to Fukuzawa et al. discloses another washing machine which sprays a circulated washing liquid onto articles to be washed through a spraying port, thereby preventing the articles from floating and improving the washing efficiency.

However, in Fukuzawa's washing machine, the spraying port is provided at one spot of an upper portion of an outer tub, so the washing liquid does not evenly spray onto the articles.

Accordingly, it is required to provide a washing machine which can evenly and strongly spray the circulated washing liquid onto the articles to be washed, thereby improving the washing efficiency.

SUMMARY OF THE INVENTION

The present invention has been made to overcome the above described problems of the prior arts and accordingly, it is an object of the present invention to provide a washing machine which evenly and strongly sprays the circulated washing liquid onto the articles to be washed, thereby improving the washing efficiency.

To achieve the above object, the present invention provides a washing machine comprising:

a housing;

an outer tub disposed in the housing so as to receive a washing liquid;

a spin tub accommodated in the outer tub, the spin tub having a plurality of discharging holes at a side wall thereof and being driven by a motor;

an outer tub cover mounted on the outer tub;

a gear assembly connected to the motor, the gear assembly receiving a rotational force from the motor and transmitting the rotational force to the spin tub or to a pulsator mounted on a bottom wall of the spin tub;

a spraying nozzle assembly for spraying the washing liquid onto an article to be washed which is loaded in the spin tub; and a circulation pump disposed at a lower portion of the housing and communicated with the outer tub, the circulation pump circulating the washing liquid into the spraying nozzle assembly through a circulation tube, or draining the washing liquid out of the washing machine through a draining tube, wherein the spraying nozzle assembly includes an upper frame mounted on an upper surface of the outer tub cover and a lower frame which is rotatably coupled to a lower portion of the upper frame, the lower frame being formed at a bottom wall thereof with a plurality of spraying nozzles which are regularly arranged in a spiral pattern.

According to a preferred embodiment of the present invention, the spraying nozzle assembly is fixedly coupled to the outer tub cover by means of a bolt. The outer tub cover is detachably coupled to the outer tub.

The upper frame has an annular shape and is formed integrally with a pair of knobs which are disposed on a circumference of the upper frame in opposition to each other and are extended in a transverse direction. The pair of knobs are fixedly coupled to the outer tub cover. In addition, the upper frame is provided at an underside thereof with a first annular ridge portion which is formed around a circumference of the upper frame and extends downwards therefrom, a second annular ridge portion which is radially spaced inward at a first predetermined distance apart from the first annular ridge portion and extends downwards therefrom, and an upper annular groove formed between the first annular ridge portion and the second annular ridge portion.

The first annular ridge portion is integrally formed at a first distal end thereof with a first annular protrusion which extends by a first predetermined length towards the second annular ridge portion, and the second annular ridge portion is integrally formed at a second distal end thereof with a second annular protrusion which extends by a second predetermined length towards the first annular ridge portion.

The upper frame has an aperture for receiving the washing liquid. The aperture is formed at a predetermined position on the circumference of the upper frame. In addition, the upper annular groove is provided with a shielding plate for ensuring a one-way flowing of the washing liquid.

The lower frame has an annular shape. The lower frame is provided at an upper surface thereof with a third annular ridge portion, a fourth annular ridge portion, and a lower annular groove formed between the third and fourth annular ridge portions. The third annular ridge portion is formed around a circumference of the lower frame and extends upwards therefrom. The fourth annular ridge portion is radially spaced inward at a second predetermined distance apart from the third annular ridge portion and extends upwards therefrom.

The lower annular groove is incorporated with the upper annular groove so as to form a space for receiving the circulated washing liquid.

The third annular ridge portion is integrally formed at a third distal end thereof with a first annular shoulder which extends radially outward by a third predetermined length, and the fourth annular ridge portion is integrally formed at a fourth distal end thereof with a second annular shoulder which extends radially inward by a fourth predetermined length. The first and second shoulders are rotatably rested on upper surfaces of first and second annular protrusions, respectively.

A plurality of partitions are disposed in the lower annular groove. The partitions are regularly spaced from each other. In addition, each of the spraying nozzles extends downward by a predetermined length from an under surface of the lower frame.

The washing machine having the construction as described above operates as follows.

Firstly, when a user pushes an operating button installed on a control panel, the washing liquid is introduced from a liquid source into the outer tub.

Then, when the liquid level in the outer tub reaches a predetermined liquid level, a liquid feed control valve blocks a liquid feeding pipe, so the supply of the washing liquid stops. At the same time, the motor rotates in the forward and reverse directions. The rotational force of the motor is transmitted to the pulsator, so the pulsator rotates in the forward and reverse directions, thereby washing the articles.

At the same time, a pump motor accommodated in the circulation pump operates in accordance with a predetermined algorithm. As the pump operates, the circulation pump also operates, so some of the washing liquid is discharged from the outer tub into the circulation pump.

Upon receiving the washing liquid, the circulation pump compresses the washing liquid and circulates the washing liquid into the spraying nozzle assembly mounted on the upper surface of the outer tub cover. Since the shielding plate is provided in the upper annular groove, the washing liquid which has flowed into the upper annular groove flows in the one-way direction along the space formed by the upper annular groove and the lower annular groove.

While flowing along the space, the washing liquid collides with the partitions, and as a result of this collision, the lower frame rotates along the flowing direction of the washing liquid. At the same time, the washing liquid is sprayed onto the articles placed in the spin tub through the spraying nozzles which are formed at the bottom of the lower annular groove. In the washing machine according to the present invention, the circulating and spraying of the washing liquid continuously repeat while the washing cycle is being executed.

As described above, the washing machine of the present invention can evenly and strongly spray the circulated washing liquid onto the articles through the spraying nozzles arranged in the spiral pattern, so the washing effect can be improved without wasting any washing liquid.

Further, since the lower frame rotates while the washing liquid is being sprayed, the washing liquid does not concentrate at one spot of the articles, but sprays more widely onto the articles.

BRIEF DESCRIPTION OF THE DRAWINGS

The above objects and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
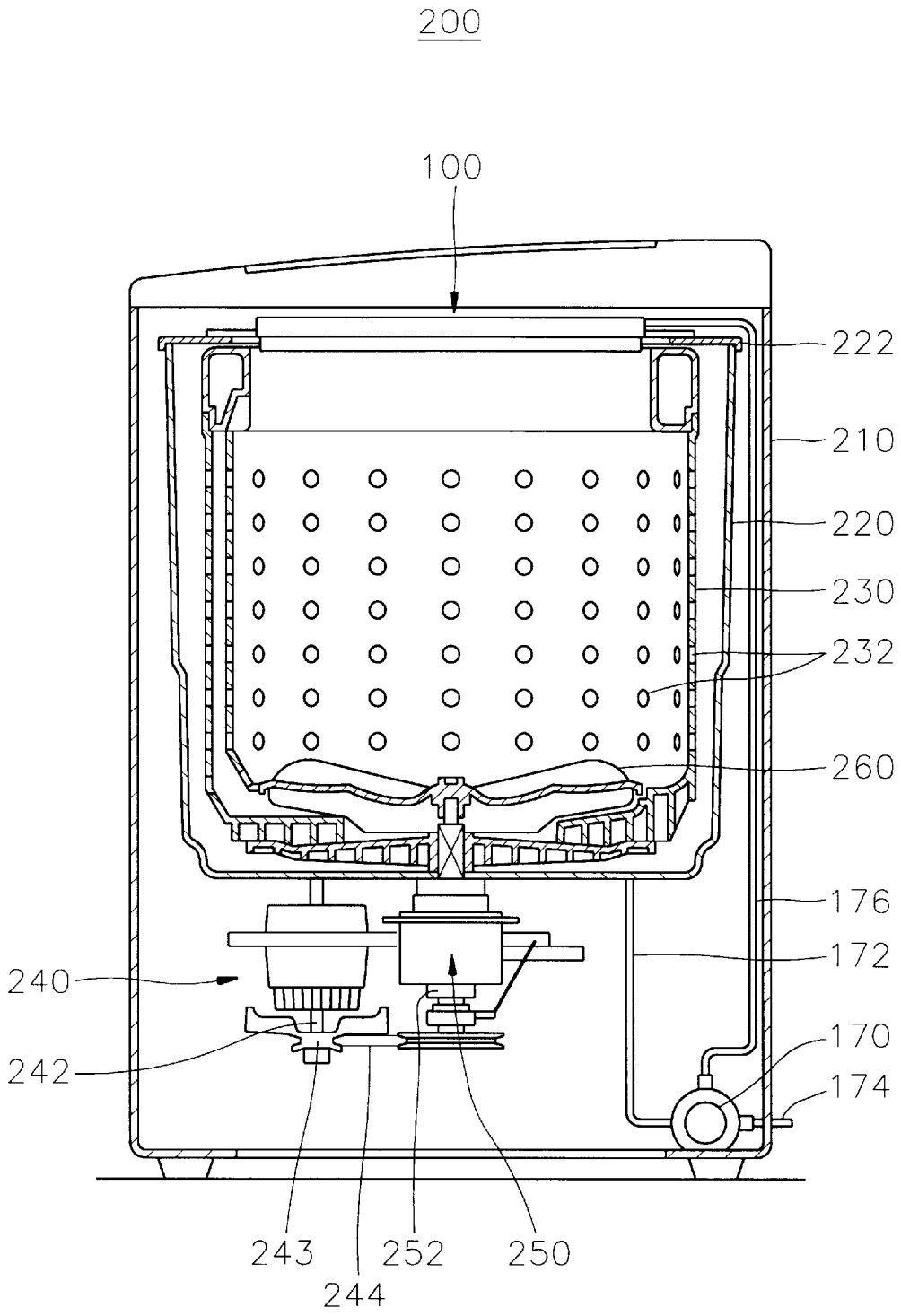
FIG. 1 is a sectional view showing the structure of a washing machine according to one embodiment of the present invention.

FIG. 1 shows a washing machine 200 according to one embodiment of the present invention.

As shown in FIG. 1, washing machine 200 has a housing 210. An outer tub 220 is disposed in housing 210 so as to receive a washing liquid, and a spin tub 230 is accommodated in outer tub 220. Spin tub 230 is formed at its side wall with a plurality of discharging holes 232. Disposed below outer tub 220 are a motor 240 generating a rotational force for operating washing machine 200, and a gear assembly 250 which receives the rotational force from motor 240 and then transmits the rotational force to spin tub 230 or to a pulsator 260 mounted on a bottom wall of spin tub 230. According to a preferred embodiment of the present invention, motor 240 includes a reversible motor.

An outer tub cover 222 is mounted on an upper portion of outer tub 220 and a spraying nozzle assembly 100 is mounted on an upper surface of outer tub cover 222 so as to spray the washing liquid onto the clothing. Spraying nozzle assembly 100 is fixedly coupled to outer tub cover 222 by well known fastening means such as a bolt or fusion welding. In order to easily put the clothing to be washed into spin tub 230, outer tub cover 222 is detachably coupled to outer tub 220.

A circulation pump 170 is disposed at a lower portion of housing 210 and is communicated with outer tub 220 so as to circulate the washing liquid into spraying nozzle assembly 100 or so as to drain the washing liquid out of washing machine 200 through a drain tube 174.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Figure 2:
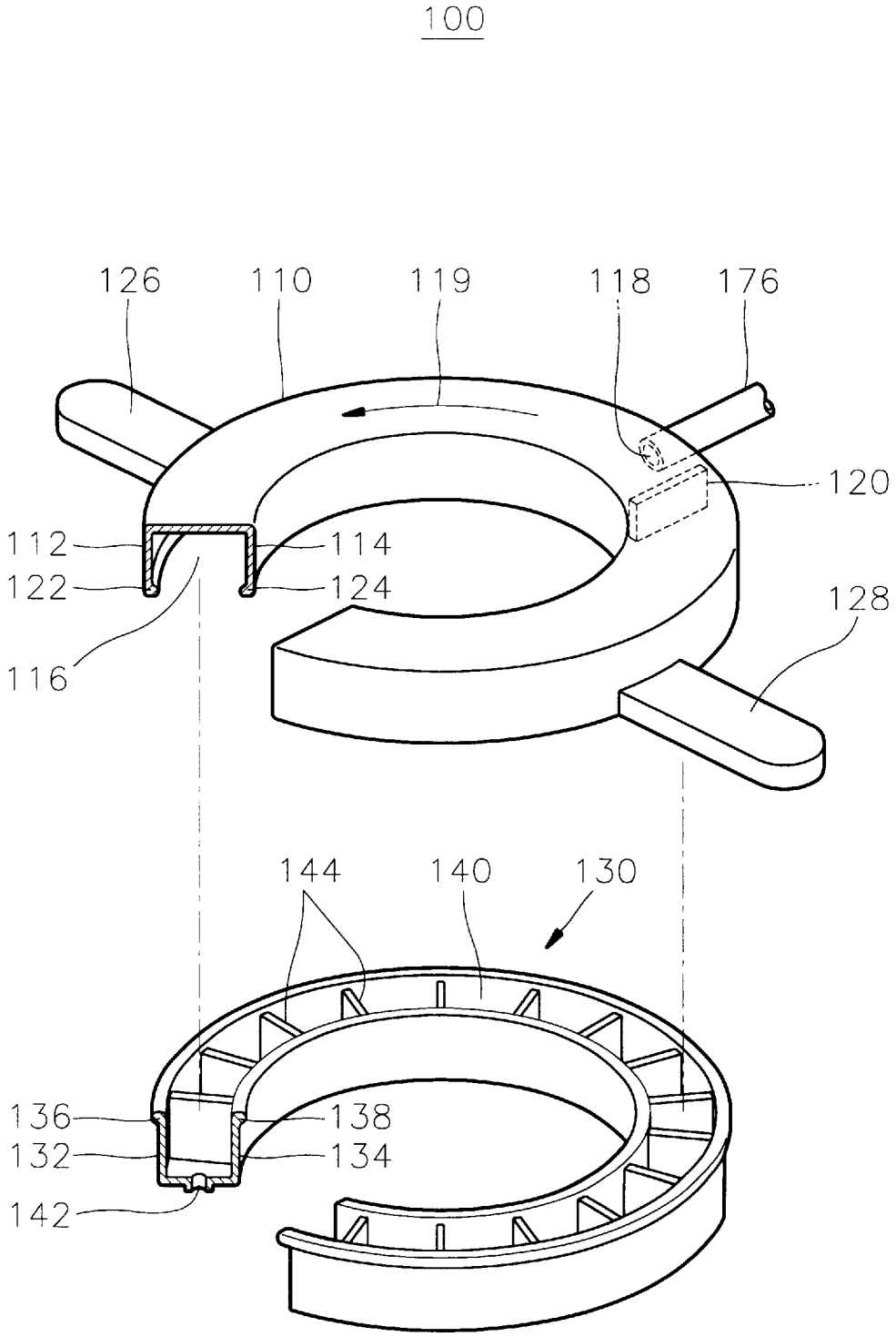
FIG. 2 is an exploded perspective view of a spraying nozzle assembly shown in FIG. 1.

Referring to FIG.2, spraying nozzle assembly 100 has an upper frame 110 and a lower frame 130 which is rotatably coupled to a lower portion of upper frame 110.

Upper frame 110 has an annular shape and is formed integrally with a pair of knobs 126 and 128 which are disposed in opposition to each other at a circumference of upper frame 110 and extend in a transverse direction. The pair of knobs 126 and 128 are fixedly coupled to outer tub cover 222, so spraying nozzle assembly 100 is stably maintained at the upper portion of outer tub 220 while washing machine 200 is being executed.

Upper frame 110 is provided at its underside with a first annular ridge portion 112 which is formed around the circumference of upper frame 110 and extends downwards therefrom, and with a second annular ridge portion 114 which is radially spaced inward at a predetermined distance apart from first annular ridge portion 112 and extends downwards therefrom. Accordingly, an upper annular groove 116 is formed between first annular ridge portion 112 and second annular ridge portion 114.

A first annular protrusion 122, which extends by a predetermined length towards second annular ridge portion 114, is integrally formed with a distal end portion of first annular ridge portion 112, and a second annular protrusion 124, which extends by a predetermined length towards first annular ridge portion 112, is integrally formed with a distal end portion of second annular ridge portion 114. In addition, an aperture 118, into which circulation tube 176 is inserted, is formed at a predetermined position on the circumference of upper frame 110.

A shielding plate 120, which ensures a one-way flowing of the washing liquid that has been introduced into spraying nozzle assembly 100 through circulation tube 176, is provided in upper annular groove 116 in the vicinity of aperture 118. Shielding plate 120 is designed such that it does not make contact with lower frame 130.

Lower frame 130 also has an annular shape. Lower frame 130 is provided at its upper surface with a third annular ridge portion 132 which is formed around the circumference of lower frame 130 and extends upwards therefrom, and with a fourth annular ridge portion 134 which is radially spaced inward at a predetermined distance apart from third annular ridge portion 134 and extends upwards therefrom. Accordingly, a lower annular groove 140 is formed between third annular ridge portion 132 and fourth annular ridge portion 134. Lower annular groove 140 is incorporated with upper annular groove 116 so as to form a space for receiving the circulated washing liquid.

A first annular shoulder 136, which extends radially outward by a predetermined length, is integrally formed with a distal end portion of third annular ridge portion 132. A second annular shoulder 138, which extends radially inward at a predetermined length, is integrally formed with a distal end portion of fourth annular ridge portion 134.

Figure 3:
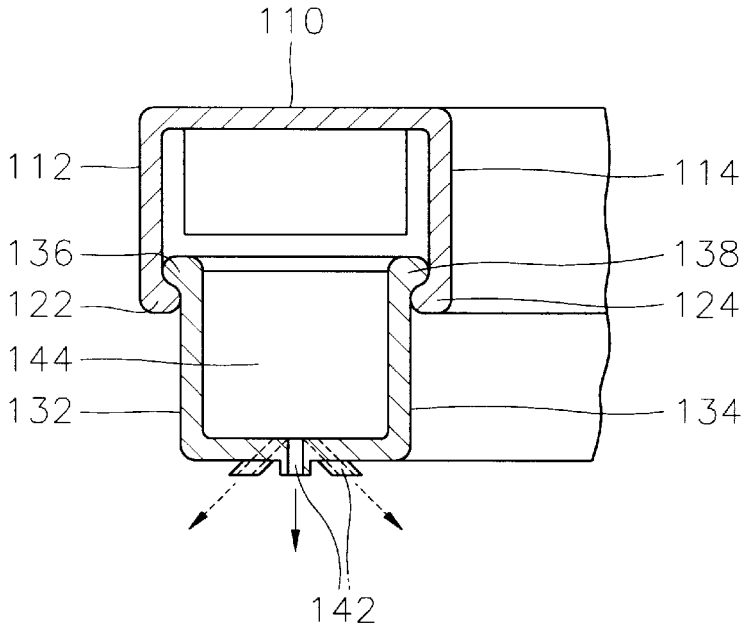
FIG. 3 is a sectional view showing a lower frame of the spraying nozzle assembly coupled to an upper frame of the spraying nozzle assembly.

As shown in FIG. 3 in detail, first and second shoulders 136 and 138 are inserted into upper annular groove 116 by means of a press fit and are rotatably rested on upper surfaces of first and second annular protrusions 122 and 124, respectively.

Referring again to FIG. 2, a plurality of partitions 144 which are regularly spaced from each other, are disposed in lower annular groove 140. The number of partitions is selectively determined in accordance with a size of the spraying nozzle assembly. Partitions 144 make contact with the circulated washing liquid introduced into spraying nozzle assembly 100, thereby rotating lower frame 130. In addition, a plurality of spraying nozzles 142 are formed at a bottom of lower annular groove 130.

Figure 4:
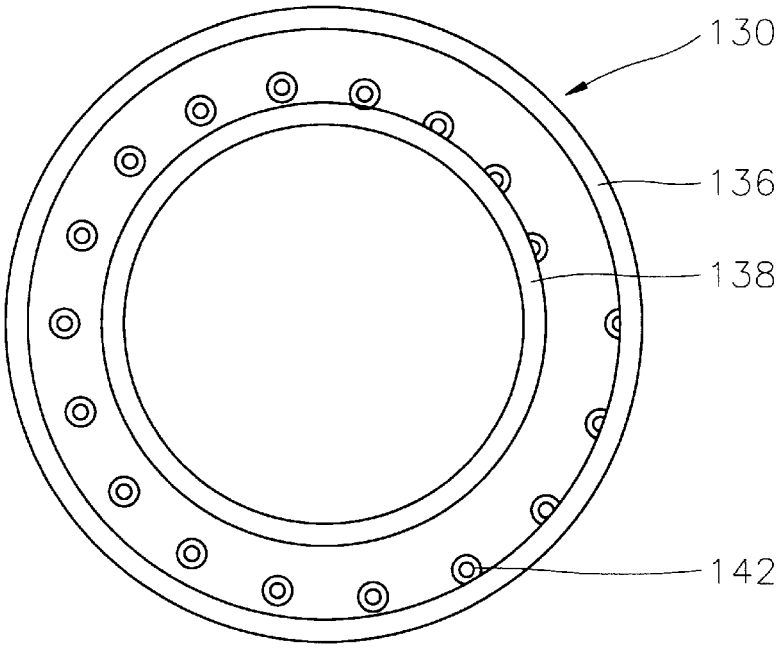
FIG. 4 is a bottom view of the lower frame of the spraying nozzle assembly.
Figure 5:
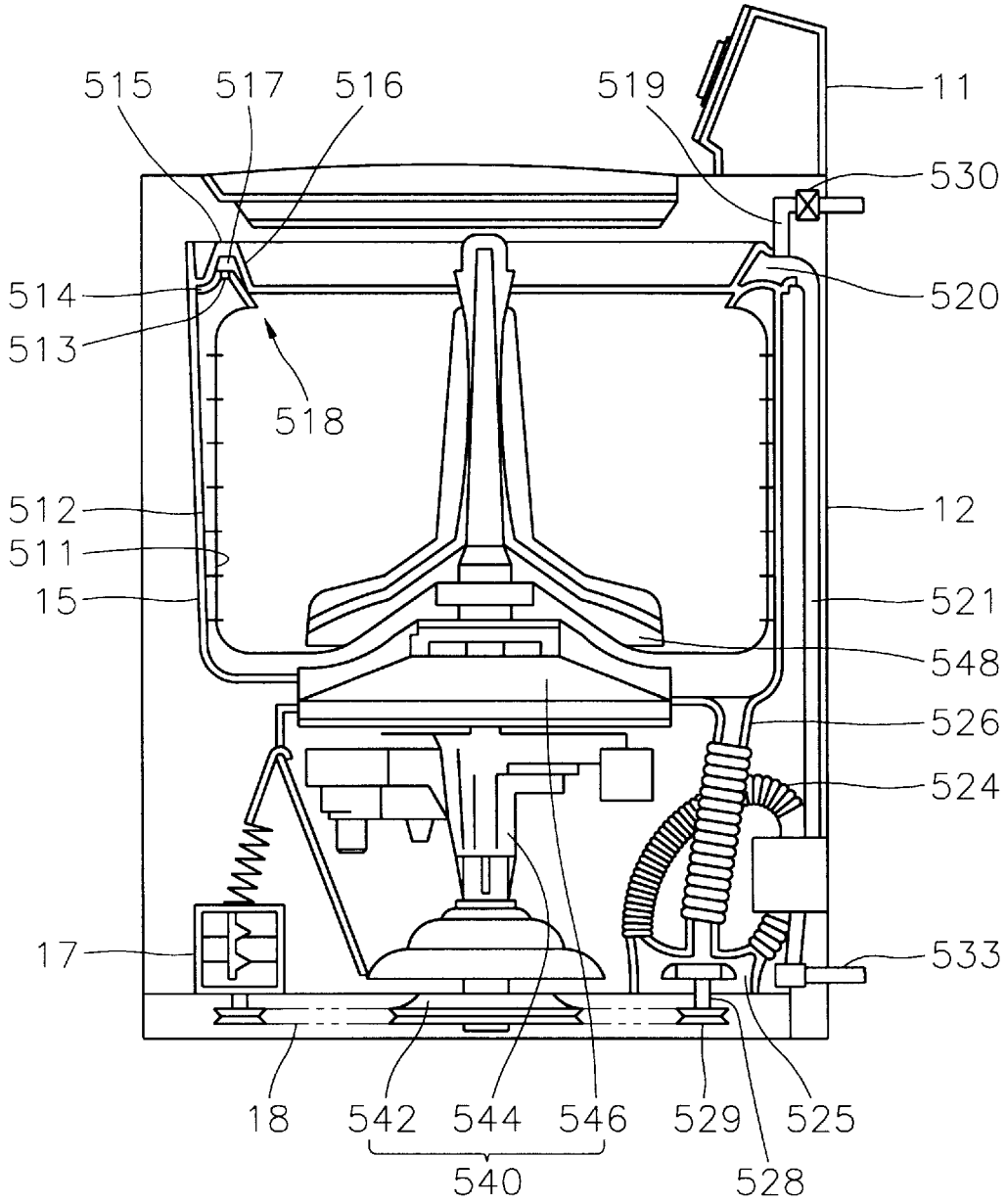
FIG. 5 (PRIOR ART)
FIG. 5 is a sectional view showing the structure of a conventional washing machine.

As shown in FIG. 4 in detail, spraying nozzles 142 are regularly arranged in a spiral pattern. By arranging spraying nozzles 142 in the spiral pattern as shown in FIG. 4, the washing liquid is sprayed onto the articles while forming a spiral liquid column, so the washing liquid is strongly and evenly sprayed onto the articles to be washed. In addition, since lower frame 130 is rotated by means of a liquid pressure while the washing liquid is being sprayed onto the articles, the washing liquid is sprayed onto the articles more evenly.

According to another embodiment of the present invention, each spraying nozzle extends downwards from the under surface of lower frame 130. In this case, the washing liquid is more easily and strongly sprayed onto the articles. In addition, several spraying nozzles can extend towards the inner wall of spin tub 230. In this case, foam or suds formed between spin tub 230 and outer tub 220 can be removed while the washing cycle is being executed.

Washing machine 200 having the construction as described above operates as follows.

Firstly, when a user pushes an operating button installed on a control panel, the washing liquid is introduced from a liquid source into outer tub 220 until a liquid level in outer tub 220 reaches a predetermined level.

Then, when the liquid level in outer tub 220 reaches the predetermined liquid level, a liquid feed control valve blocks a liquid feeding pipe, so the supply of the washing liquid stops. At the same time, motor 240 rotates in the forward and reverse directions. The rotational force of motor 240 is transmitted to pulsator 260 by way of motor shaft 242, by way of first pulley 243, by way of belt 244, by way of second pulley 254, and by way of gear assembly 250. As a result, pulsator 260 rotates in the forward and reverse directions, thereby washing the articles.

At the same time, an operating signal is transmitted to the pump motor accommodated in circulation pump 170 in accordance with a predetermined algorithm so that the pump motor rotates in the forward direction. When the pump motor rotates in the forward direction, a first valve disposed between circulation pump 170 and circulation tube 176 is opened and a second valve disposed between circulation pump 170 and drain tube 174 is closed. In addition, as the pump operates, circulation pump 170 also operates, so that some of the washing liquid that has been introduced into outer tub 220 is discharged from outer tub 220 into circulation pump 170 through discharging tube 172.

Upon receiving the washing liquid, circulation pump 170 compresses the washing liquid and circulates the washing liquid through circulation tube 176 into spraying nozzle assembly 100 mounted on the upper surface of outer tub cover 222.

That is, the compressed washing liquid flows into upper annular groove 116 through aperture 118. As mentioned above, since shielding plate 120 is provided in upper annular groove 116, the washing liquid which has flowed into upper annular groove 116 flows in the direction indicated by an arrow 119 in FIG. 2, along the space formed by upper annular groove 116 and lower annular groove 118.

While flowing along the space, the washing liquid collides with partitions 144, and as a result of this collision, lower frame 130 rotates along the flowing direction of the washing liquid. At the same time, the washing liquid is sprayed onto the articles placed in spin tub 230 through spraying nozzles 142 which are formed at the bottom of lower annular groove 140.

At this time, since spraying nozzles 142 are arranged in the spiral pattern, the washing liquid can be evenly sprayed onto inner and outer portions of the articles. In addition, since lower frame 130 rotates while the washing liquid is being sprayed, the washing liquid does not concentrate at one spot of the articles, but sprays widely onto the articles.

In washing machine 200 according to the present invention, the circulating and spraying of the washing liquid continuously repeats while the washing cycle is being executed, and spraying nozzle assembly 100 sprays the circulated washing liquid onto the articles strongly, so the washing effect is improved without wasting any washing liquid.

When the washing cycle has finished, the pump motor rotates in the reverse direction. At this time, the first valve disposed between circulation pump 170 and circulation tube 176 is closed, and the second valve disposed between circulation pump 170 and drain tube 174 is opened. Accordingly, the washing liquid filled in outer tub 220 is drained out of washing machine 200 by way of discharging tube 172, by way of circulation pump 170, and by way of draining tube 174.

As described above, the washing machine of the present invention can evenly and strongly spray the circulated washing liquid onto the articles through the spraying nozzles arranged in the spiral pattern, so the washing effect can be improved without wasting any washing liquid.

Further, since the lower frame rotates while the washing liquid is being sprayed, the washing liquid does not concentrate at one spot of the articles, but sprays more widely onto the articles.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

a housing;

an outer tub disposed in the housing so as to receive a washing liquid;

a spin tub accommodated in the outer tub, the spin tub having a plurality of discharging holes at a side wall thereof and being driven by a motor;

an outer tub cover mounted on the outer tub;

a gear assembly connected to the motor, the gear assembly receiving a rotational force from the motor and transmitting the rotational force to the spin tub or to a pulsator mounted on a bottom wall of the spin tub;

a spraying nozzle assembly for spraying the washing liquid onto an article to be washed which is loaded in the spin tub; and a circulation pump disposed at a lower portion of the housing and communicated with the outer tub, the circulation pump circulating the washing liquid into the spraying nozzle assembly through a circulation tube or draining the washing liquid out of the washing machine through a draining tube, wherein the spraying nozzle assembly includes an upper frame mounted on an upper surface of the outer tub cover, and a lower frame rotatably coupled to a lower portion of the upper frame, the lower frame being formed at a bottom wall thereof with a plurality of spraying nozzles which are regularly arranged in a spiral pattern.

2. The washing machine as claimed in claim 1, wherein the motor includes a reversible motor.

3. The washing machine as claimed in claim 1, wherein the outer tub cover is detachably coupled to the outer tub.

4. The washing machine as claimed in claim 1, wherein the upper frame has an annular shape and is formed integrally with a pair of knobs which are disposed at a circumference of the upper frame in opposition to each other and extend in a transverse direction, the pair of knobs being fixedly coupled to the outer tub cover.

5. The washing machine as claimed in claim 1, wherein the upper frame is provided at an underside thereof with a first annular ridge portion which is formed around a circumference of the upper frame and extends downwards therefrom, a second annular ridge portion which is radially spaced inward at a first predetermined distance apart from the first annular ridge portion and extends downwards therefrom, and an upper annular groove formed between the first annular ridge portion and the second annular ridge portion.

6. The washing machine as claimed in claim 5, wherein the first annular ridge portion is integrally formed at a first distal end thereof with a first annular protrusion which extends by a first predetermined length towards the second annular ridge portion, and the second annular ridge portion is integrally formed at a second distal end thereof with a second annular protrusion which extends by a second predetermined length towards the first annular ridge portion.

7. The washing machine as claimed in claim 6, wherein the upper frame has an aperture for receiving the washing liquid, the aperture being formed at a predetermined position on the circumference of the upper frame.

8. The washing machine as claimed in claim 6, wherein the upper annular groove is provided with a shielding plate for ensuring a one-way flowing of the washing liquid.

9. The washing machine as claimed in claim 6, wherein the lower frame has an annular shape, the lower frame being provided at an upper surface thereof with a third annular ridge portion, a fourth annular ridge portion, and a lower annular groove formed between the third and fourth annular ridge portions, the third annular ridge portion being formed around a circumference of the lower frame and extending upwards therefrom, the fourth annular ridge portion being radially spaced inward at a second predetermined distance apart from the third annular ridge portion and extending upwards therefrom.

10. The washing machine as claimed in claim 9, wherein the lower annular groove is incorporated with the upper annular groove so as to form a space for receiving the circulated washing liquid.

11. The washing machine as claimed in claim 9, wherein the third annular ridge portion is integrally formed at a third distal end thereof with a first annular shoulder which extends radially outward by a third predetermined length, and the fourth annular ridge portion is integrally formed at a fourth distal end thereof with a second annular shoulder which extends radially inward by a fourth predetermined length, the first and second shoulders being rotatably rested on upper surfaces of first and second annular protrusions, respectively.

12. The washing machine as claimed in claim 9, wherein a plurality of partitions are disposed in the lower annular groove, the partitions being regularly spaced from each other.

13. The washing machine as claimed in claim 1, wherein the spraying nozzles extends downward by a predetermined length from an under surface of the lower frame, and several spraying nozzles extend towards an inner wall of the spin tub.

14. A washing machine comprising:

a housing;

an outer tub disposed in the housing so as to receive a washing liquid;

a spin tub accommodated in the outer tub, the spin tub having a plurality of discharging holes at a side wall thereof and being driven by a motor;

an outer tub cover detachably mounted on the outer tub;

a gear assembly connected to the motor, the gear assembly receiving a rotational force from the motor and transmitting the rotational force to the spin tub or to a pulsator mounted on a bottom wall of the spin tub;

a spraying nozzle assembly for spraying the washing liquid onto an article to be washed which is loaded in the spin tub; and a circulation pump disposed at a lower portion of the housing and communicated with the outer tub, the circulation pump circulating the washing liquid into the spraying nozzle assembly through a circulation tube or draining the washing liquid out of the washing machine through a draining tube, wherein the spraying nozzle assembly includes an upper frame coupled to an upper surface of the outer tub cover, and a lower frame which is rotatably coupled to a lower portion of the upper frame, the lower frame being formed at a bottom wall thereof with a plurality of spraying nozzles which are regularly arranged in a spiral pattern, the upper frame having an annular shape and being formed integrally with a pair of knobs which are disposed at a circumference of the upper frame in opposition to each other and which extends in a transverse direction, the pair of knobs being fixedly coupled to the outer tub cover, the upper frame being provided at an underside thereof with a first annular ridge portion which is formed around a circumference of the upper frame and extends downwards therefrom, a second annular ridge portion which is radially spaced inward at a first predetermined distance apart from the first annular ridge portion and extends downwards therefrom, and an upper annular groove formed between the first annular ridge portion and the second annular ridge portion, the first annular ridge portion being integrally formed at a first distal end thereof with a first annular protrusion which extends by a first predetermined length towards the second annular ridge portion, the second annular ridge portion being integrally formed at a second distal end thereof with a second annular protrusion which extends by a second predetermined length towards the first annular ridge portion, the upper frame having an aperture for receiving the washing liquid, the aperture being formed at a predetermined position on the circumference of the upper frame, the upper annular groove being provided with a shielding plate for ensuring a one-way flowing of the washing liquid, the lower frame having an annular shape, the lower frame being provided at an upper surface thereof with a third annular ridge portion, a fourth annular ridge portion, and a lower annular groove formed between the third and fourth annular ridge portions, the third annular ridge portion being formed around a circumference of the lower frame and extending upwards therefrom, the fourth annular ridge portion being radially spaced inward at a second predetermined distance apart from the third annular ridge portion and extending upwards therefrom, the lower annular groove being incorporated with the upper annular groove so as to form a space for receiving the circulated washing liquid, the third annular ridge portion being integrally formed at a third distal end thereof with a first annular shoulder which extends radially outward by a third predetermined length, the fourth annular ridge portion being integrally formed at a fourth distal end thereof with a second annular shoulder which extends radially inward by a fourth predetermined length, the first and second shoulders being rotatably rested on upper surfaces of first and second annular protrusions, respectively, the lower annular groove being provided with a plurality of partitions, the partitions being regularly spaced from each other, each of the spraying nozzles extending downward by a predetermined length from an under surface of the lower frame.

* * * * *